US006612090B1

(12) United States Patent
Corden

(10) Patent No.: US 6,612,090 B1
(45) Date of Patent: Sep. 2, 2003

(54) NON-COMBUSTIBLE PANEL WALL SYSTEM

(75) Inventor: David A. Corden, P.O. Box 23964, Knoxville, TN (US) 37933

(73) Assignee: David A. Corden, Knoxville, TN (US)

( * ) Notice: Subject to any disclaimer, the term of this patent is extended or adjusted under 35 U.S.C. 154(b) by 0 days.

(21) Appl. No.: 10/001,109

(22) Filed: Nov. 2, 2001

(51) Int. Cl.[7] ..... E04B 2/00

(52) U.S. Cl. ..... 52/762; 52/235; 52/475.1; 52/781; 52/506.08; 52/730.1

(58) Field of Search ..... 52/238.1, 235, 52/384, 475.1, 762, 764, 775, 780, 781, 506.05, 506.06, 506.08, 510, 511, 733.2, 730.1; 211/87.01, 94.01

(56) References Cited

U.S. PATENT DOCUMENTS 2,633,652 A * 4/1953 Wagner et al. ..... 40/622
2,653,686 A * 9/1953 Routt ..... 52/506.08
2,664,978 A * 1/1954 Fox ..... 52/474
3,626,650 A * 12/1971 Lickliter et al. ..... 52/288.1
3,722,163 A * 3/1973 Satkin et al. ..... 52/126.3
4,231,197 A * 11/1980 Caplan et al. ..... 52/36.6
4,330,974 A * 5/1982 Fleisch et al. ..... 52/489.1
4,370,838 A 2/1983 Vermillion
4,459,790 A 7/1984 Vermillion
4,704,835 A * 11/1987 Jordan ..... 52/489.1
4,918,879 A * 4/1990 Bodurow et al. ..... 52/36.6
5,185,971 A * 2/1993 Johnson, Jr. ..... 52/36.6
5,285,602 A * 2/1994 Felton ..... 52/36.6
5,390,457 A * 2/1995 Sjolander ..... 52/387
5,791,093 A 8/1998 Diamond
6,115,977 A 9/2000 Hornberger et al.
6,185,899 B1 * 2/2001 De Niet ..... 52/762
6,336,298 B1 * 1/2002 Chou ..... 52/238.1
6,430,885 B1 * 8/2002 Ito ..... 52/483.1

* cited by examiner

*Primary Examiner*—Brian E. Glessner
(74) *Attorney, Agent, or Firm*—Pitts & Brittian, PC

(57) ABSTRACT

Panel wall system including a plurality of standards, each formed from a non-combustible material and mounted in a spaced-apart upright attitude on a supporting surface. Each standard includes a planar face web and opposite side webs. A plurality of lugs project from the side webs along the length of the standard and serve to removably mount panel members between adjacent standards. All components of the wall system are of a non-combustible material.

17 Claims, 4 Drawing Sheets

NON-COMBUSTIBLE PANEL WALL SYSTEM

FIELD OF THE INVENTION

This invention relates to panel wall systems of the type wherein one or more elongated standards is mounted to a supporting surface, such as a building wall, and one or more removable panels are mounted to the standards.

BACKGROUND OF THE INVENTION

Panel wall systems are commonly employed in retail establishments for the display of merchandise. These systems commonly utilize panels as a background for the display and commonly include shelves which project from the plane of the panel wall system to receive the merchandise.

In the prior art, it is known to attach a plurality of horizontally oriented and spaced apart channel members to the surface of a building wall, or the like, to attach a plurality of vertically oriented standards to these channel members at spaced apart locations along the length of the channels, and thereafter, to removably mount one or more planar panels between adjacent ones of the standards. U.S. Pat. No. 4,660,339 discloses one such prior art panel wall system. This and other prior art panel wall systems are based upon a grid concept wherein the channels and standards must be carefully located and secured relative to one another to ensure vertical orientation of the standards so that rectangular panels may be received between adjacent ones of the standards. Preferably, these panels are removably received between the standards to permit periodic change of the background of a merchandise display.

For economic reasons, panel wall systems are commonly fabricated from inexpensive materials. Combustibility of the materials has not heretofore been of material concern. However, current and proposed regulations promulgated by regulatory and/or governmental agencies require that the panel wall system be non-combustible, much in the same manner that the wall studs in a retail establishment must be of a non-combustible material.

The relative cost of non-combustible versus combustible raw materials for use in the fabrication of panel wall systems is of substantial concern to retail merchandisers. Where non-combustible panel wall systems are required, as by local, state and/or federal regulatory agencies, there is no choice for the merchandiser but to utilize non-combustible materials in their panel wall systems. Thus, the design of the panel wall system and the cost of installation and/or relocation of panel wall systems are variables which the merchandiser may consider for controlling the cost of a panel wall system. Careful consideration must be given, however, to the selection of the materials of construction of a panel wall system. In particular, it is desired that a panel wall system be fabricated of materials which satisfy the non-combustible requirement and which provide the strength and rigidity required to support the merchandise to be displayed, all at a minimum overall cost to the merchandiser. Overall cost to the merchandiser includes the initial cost of the components of the panel wall system, the cost of initial installation, and the cost associated with subsequent rearrangement of the panel wall system to accommodate changes in the panel wall system which are needed or desired for displaying different merchandise. The known prior art has failed to satisfy these needs. Particularly, the known prior art does not provide the combination of a non-combustible panel wall system which includes the feature of convenient exchange of the panels of the system after the system has been installed. Also the known prior art utilizes aluminum extrusions which are both relatively expensive and or less than desirable strength and/or rigidity.

SUMMARY OF THE INVENTION

Unless otherwise obvious from the context of their use, primed numerals are employed to designate like components or elements of the depicted embodiments among the several Figures.

In accordance with one aspect of the present invention, there is provided a panel wall system which comprises a plurality of standards, each formed from a non-combustible material, which are mountable in an upright attitude at spaced apart locations on a supporting surface, such as the common wall of a building. Each standard includes a planar face web, which is oriented in a plane which is spaced apart from, and commonly parallel to, the supporting surface, and opposite side webs which project substantially perpendicularly from the opposite side edges of the face web. In a preferred embodiment each of the side webs transitions into a planar wing which is integrally formed with its respective side web and projects outwardly of the standard and along its length. At precisely spaced apart locations along the length of each wing there are provided holes for use in mounting of the standard to its supporting wall. At spaced apart locations along each side web, there is provided a plurality of lugs, each of which, for example, may comprise a punch-out of the side web. These lugs are spaced apart by predetermined distances along the length of their respective standard.

The present system further includes a plurality of panel members, each formed of a non-combustible material and preferably rectangular in geometry, each of which includes a planar front face. Each panel member includes a lug on each of the opposite side of the panel and which projects rearwardly of the panel in a direction which is substantially perpendicular to the planar front face of the panel. In a preferred embodiment, each panel includes at least four such lugs, one each located at each of the four corners of the panel. Each panel is sized to fit between adjacent ones of the standards with the lugs on the panel being adapted to removably engage the lugs on the standards to thereby removably mount each panel between the adjacent standards. The spacing and dimensioning of the lugs and their interconnection are chosen to cause the planar front face of each panel to be in substantially the same plane as the plane occupied by the planar face webs of the standards and for the panel face and the face web to be flush with one another.

In accordance with one aspect of the present invention, the planar web of each standard is provided along its length with at least one row, and preferably two parallel rows of openings therethrough for the receipt of mounting lugs of shelf brackets, for example, of the type well known in the art, further, the front face of each panel member optionally includes one or more slots through the thickness thereof, each slot including an associated ledge which projects away from the rear face of the panel to define one or more receptacles for pegboard-type hangers.

DETAILED DESCRIPTION OF THE INVENTION

Figure 1:
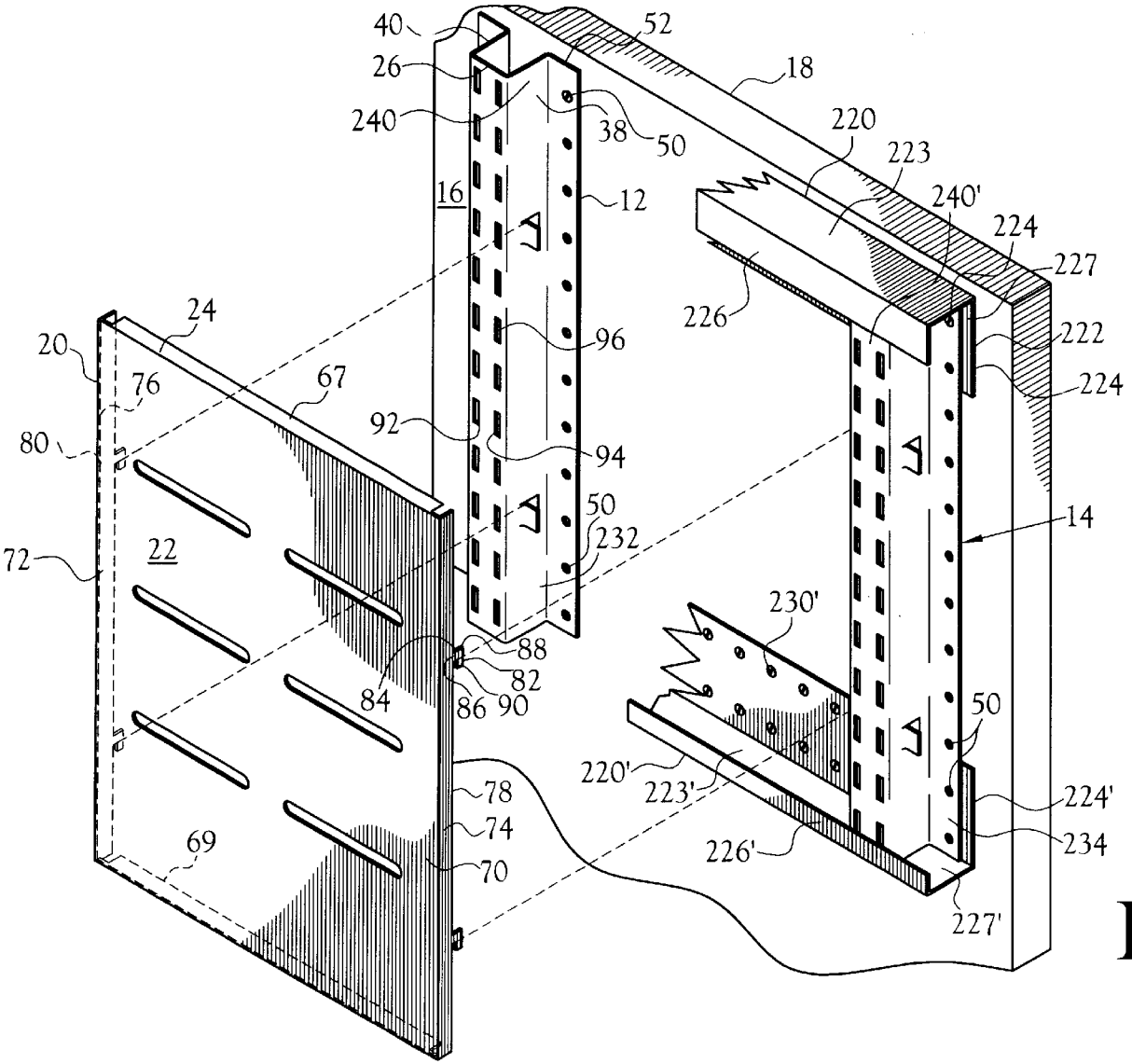
FIG. 1 is a representation of a portion of a panel wall system embodying various features of the present invention.

With reference to FIG. 1, in one embodiment of the present invention, there is provided a plurality of upright elongated standards 12, 14 which are individually removably secured directly to the face 16 of a wall 18 of a building or the like. The standards 12 and 14 are oriented substantially parallel, and in spaced apart relationship, to one another by a distance sufficient to receive therebetween one or more planar display panels 20, each having a front face 22 and a rear face 24.

Figure 2:
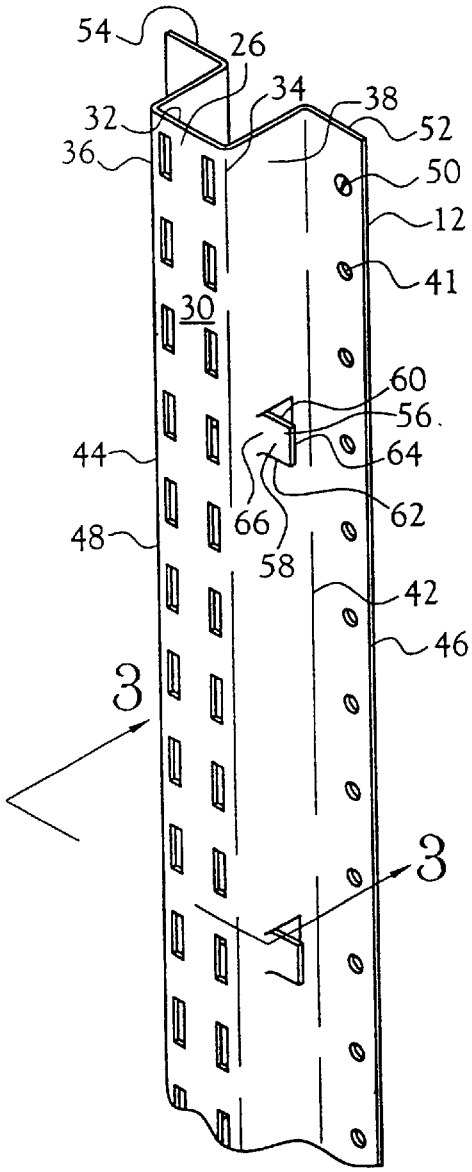
FIG. 2 is a representation of a portion of a standard suitable for use in the present panel wall system.

In accordance with one aspect of the present invention, each standard is fabricated from a non-combustible material, such as a metal, preferably steel, and most preferably 14 gauge cold rolled steel. Referring to FIGS. 1 and 2, each standard includes a flat planar face web 26 having a front surface 30 and a rear surface 32, and first and second opposite side margins 34 and 36. Each of these side margins extends along the length of its respective face web and transitions into respective first and second opposite side webs 38, 40 that are integrally formed with the face web and which extend away from the face web to define respective distal side edges 42,44.

Figure 3:
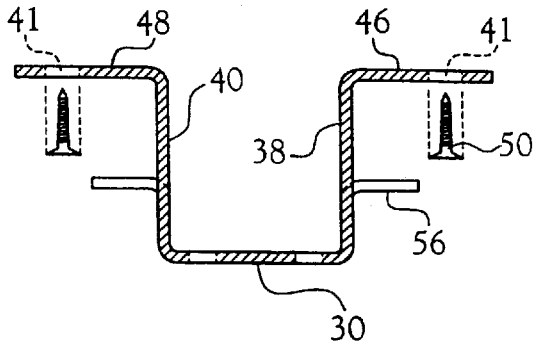
FIG. 3 is a representation of a sectional view of a standard suitable for use in the present panel wall System.

As depicted in FIGS. 1 and 2 the distal side edges 42,44 of the first and second side webs transition into first and second flat planar wings 46,48 that are integrally formed with respective ones of the distal side edges of the first and second side webs 38,40. Each wing projects outwardly of the standard and along its length, at precisely and uniformly spaced apart locations (one inch apart in one embodiment), the mounting web is provided with holes 41 which extend through the thickness of each wing and which are adapted to receive therethrough fasteners 50, such as nails, bolts, screws, or the like (see FIG. 3) which are suitable to secure the standard to a building wall, or other similar supporting surface. The first and second flat planar wings 46,48 of each standard occupy a common plane so that their rear faces 52,54 will lie flush against a supporting wall, for example. Preferably this common plane is substantially parallel to the plane occupied by the face web.

Along the length of each of the side webs 46,48, there is provided one or more lugs 56, each of which, in a preferred embodiment takes on the form of a "punch-out" from a side web 38, for example. In the depicted embodiment, each lug comprises a flat planar portion 58 of its respective side web which has been bent outwardly of, and away from, the side web after having been cut along two horizontal and one vertical sides 60,62 and 64, respectively, thereof. As depicted, the vertical cut is located intermediate the transition between the distal side edge 42 of a side web 38 and the mounting wing 46 (typical). Thus, upon punching out of the lug 56, its base 66 remains integral with its side web 38, providing strength for engagement by, and support of, a display panel 20. Moreover, the action of punching out the lug positions the lug intermediate the transition between the face web and the side web and the transition between the distal edge of the side web and the wing. Preferably, each lug is disposed within a plane which is substantially parallel, and spaced apart from, the plane which contains the first and second wings 46, 48 of a given standard.

In a preferred embodiment, the length of each of the horizontal cuts through the thickness of a side web commence with, and intersect, the vertical cut. Each such horizontal cut extends to a location spaced apart from the transition of the side web with its respective side margin of the face web thereby positioning the lug spaced apart from such transition. This separation distance between the lug and such transition is chosen to provide relative positioning of the front face of a display panel flush with the front face of the face web of the standard, thereby providing continuity of appearance of the face web of each standard with the front face of each display panel.

In accordance with a further aspect of the present invention, there is provided at least one, and commonly a plurality of, planar display panels 20, each having a front surface 22 and a rear surface 24, and top, bottom, and first and second side margins 70,72, 67,69,respectively. The display panel 20 depicted in FIG. 1, includes first and second side margins which transition into respective side webs 74, 76, each of which projects substantially perpendicularly from the front surface 22 of the panel in direction toward the rear face of the panel, to terminate in respective distal side edges 78,80. Each display panel is fabricated of a non-combustible material, such as a metal, 16 gauge cold rolled steel being one suitable material.

Referring to FIG. 1, the distal side edge of each of the first and second side webs of the display panel is provided with at least one panel lug 82 which comprises an extension of the respective distal side edge of the display panel. Each lug is flat and planar and includes a first leg 84 having its first end 86 integrally formed with the distal side edge of its respective side web, and whose length dimension extends away from the distal side edge of the side web, and a second leg 88 whose length dimension extends substantially perpendicularly downwardly from the first leg, when viewed in side elevation. Each lug 82 thus resides in the same plane as its respective side web 74 (typical) of the panel and is flush with its respective side web. The angular orientation of the length dimensions of the first and second legs 84,88 of each panel lug imparts a "hook" geometry to each lug, when viewed in a side elevational view, that includes an open space (slot) 90 defined between the second leg 88 of the lug and the adjacent distal side edge 78 of its respective side web 74. This space is selected to snugly receive therein one of the lugs 56 disposed on a standard to thereby mount one side of the panel to the standard. In a preferred embodiment, each display panel includes a panel lug adjacent each of the four corners of the display panel. By this means, each display panel may be interlocked between two adjacent, spaced-apart, standards at four locations, thereby enhancing the securement of the display panel to the standards and also enhancing the overall rigidity of the panel wall system. As desired for purposes of planar alignment of a display panel with respect to the plane occupied by the face webs of a plurality of standards, the positioning of the panel lugs relative to their respective side webs of the display panel may be selected so as to position the plane of the display panel relative to the plane of the face webs when the panel lugs engage the lugs of the standards. As depicted in FIG. 1, the spacing between the lugs on each side of a panel is the same as the spacing between the lugs on a standard so that the panel lugs register with the lugs on the standard.

Figure 5:
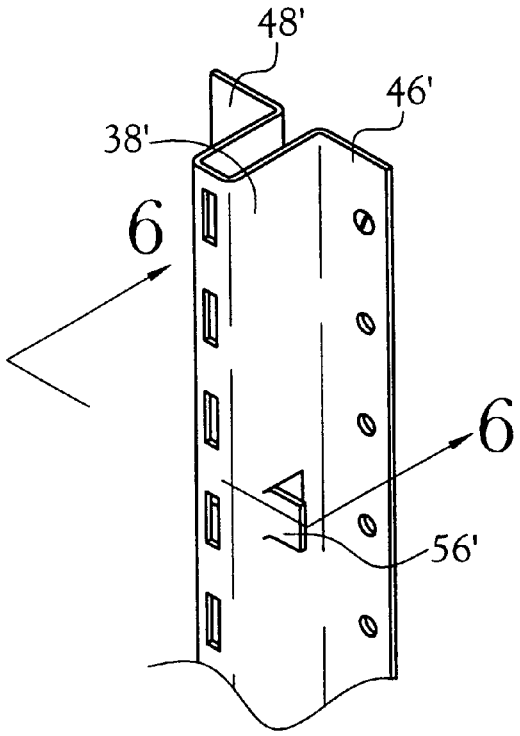
FIG. 5 is a representation of an alternative embodiment of a standard useful in one embodiment of the present invention.

In the embodiment of the standard depicted in FIGS. 1 and 2, there are provided two parallel rows 92,94 of elongated openings 96 extending through the thickness of the face web. The openings of each row preferably are spaced apart equidistantly, and serve for the receipt therein of shelf brackets of the type commonly employed in merchandise displays and which are well known in the art. As desired, only one row of elongated openings may be employed as depicted in FIG. 5. Once these shelf brackets are in place on adjacent standards, a shelf may be positioned on the brackets and aligned flush against both the face webs of the standards as well as flush against the front face of a display panel which is disposed between such adjacent standards, thereby providing a neat appearing panel wall system which is of relatively low initial cost, easily and readily installed, and conveniently adjustable and/or rearranged for display of a variety of merchandise. Importantly, the panel wall system of the present invention is noncombustible and complies with all known requirements for non-combustible merchandising display systems.

Figure 4:
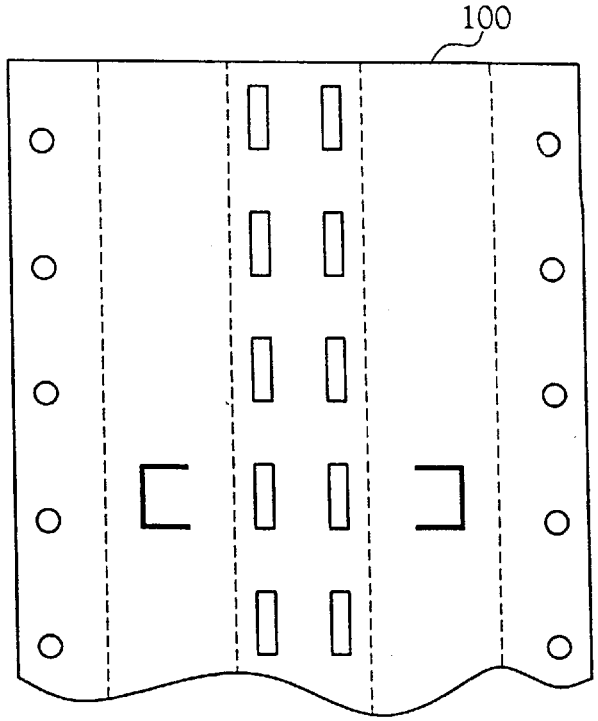
FIG. 4 is laid out flat view of a strip of metal to be formed into a standard of the type depicted in FIG. 2.

In one embodiment, a suitable standard for use in the present panel wall system, may be formed from an elongated strip of 0.074 inch thick (14 gauge) cold rolled steel having a width of about 3.75 inches. One suitable blank 100 for forming a standard is depicted in "laid out" (top plan view) format in FIG. 4. To form a standard, this blank may be formed by cold rolling the blank into the generally "U"-shaped cross-sectional geometry depicted in FIG. 3. Prior to cold rolling of the blank, the holes 41 through the thickness of the wings 46,48, and the openings 96 through the face web, as well as the punched-out lugs 56, may be formed, employing known metal-working equipment.

Figure 6:
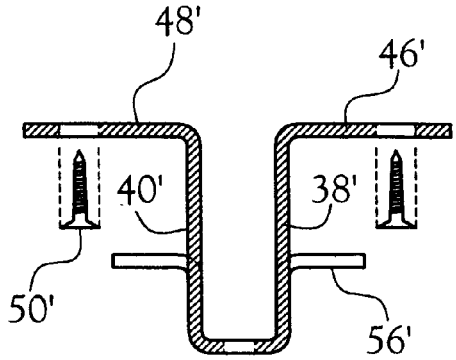
FIG. 6 is a top end view of the standard depicted in FIG. 5.

In accordance with one embodiment of the standard of the present invention, the width dimension of the web face of the standard may be reduced considerably, as desired, to reduce the footprint of exposure of the web face when one views an installed panel wall system of the present invention. One such reduced width web face is depicted in FIG. 6 and includes all of the elements of the standard depicted in FIG. 5.

Figure 7:
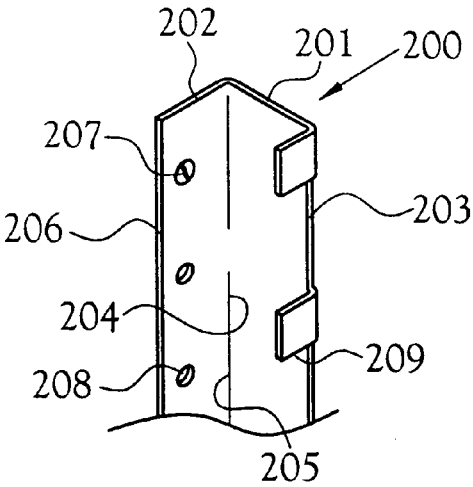
FIG. 7 is representation of the top end of an alternative embodiment of a standard useful in the present invention.
Figure 8:
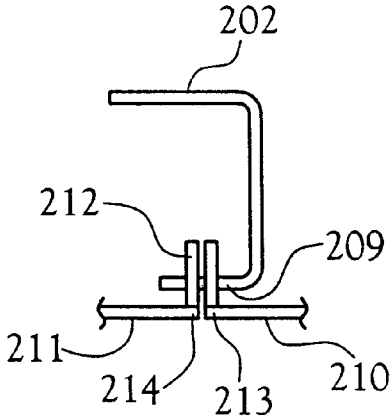
FIG. 8 is a top view of the standard depicted in FIG. 7 and including sections of two panel members secured to the standard.

With reference to FIG. 7, in one embodiment of a standard 200 useful in the present invention, the standard includes first and second webs 201 and 202 each of which includes first and second side edges 203,204 and 205,206, respectively. These webs are integrally joined along their respective second side edges 204,205 and extend substantially perpendicular to one another, defining an L-shaped cross section of the standard. The second web 202 is adapted to be removably anchored to a supporting wall, for example, as by screws 207 which pass through holes 208 provided through the thickness of the second web to engage the supporting wall. The first side edge of the first web panel is provided with lugs 209 which are integrally formed with the first web and which project laterally therefrom at spaced apart locations along the length of the standard. As seen in FIG. 8, first and second panel members 210,211 may be mounted on the lugs of a single standard employing lugs 212 provided on the side edges 213,214 of the panel members which interlock with respective ones of the lugs 209 on the standard. By this means, the side edges of the first and second panel members may be positioned in abutting relationship to thereby present a relatively smooth and continuous exposed outer surface of the panel members.

In accordance with one aspect of the present invention, the panel wall system includes a top header 220 and a bottom rail 220', each of which is of generally L-shaped cross section and including a base web 223, 220', a side web 224,224' and a return web 226,226', respectively, the side web and return web of each extending substantially perpendicularly from respective ones of the opposite side margins of the face web to define an open-sided channel 227 and 227'. The top header and the bottom rail are generally mirror images on one another.

In the present invention, the base web of the bottom rail is anchored either directly on a floor or to a supporting wall at a location adjacent, but spaced apart from the floor, for example, thereby positioning the open side of the channel 227' facing upwardly from the floor for the receipt within the channel of the bottom ends of the standards of the wall system at spaced apart locations along the length of the bottom rail. The side web of the bottom rail is provided with holes 230' through the thickness thereof at uniformly and equally spaced apart locations along the length of the bottom rail. When the bottom ends 232,234 of the standards 12,14, respectively, for example, are disposed within the channel 227', holes 50 in the wings of each standard are in register with holes 230' in the side web of the bottom rail. Screws, or other fasteners inserted in the registering holes provide for removably attachment of the bottom ends of the rails to the bottom rail.

In like manner, the top ends of the standards may be received within the channel 227 of the top header, and attached to the side web 224 of the top header such as depicted in FIG. 1. As noted, the top header of FIG. 1, comprises an elongated member having a generally "J"-shaped cross section which defines an open-sided channel 227 along the length of the top header which is adapted to receive therein the top ends 240, 240' of the standards 12,14 of the panel wall system. When so positioned the top header overlies the top ends of the standards, with the return web overlying the front faces of the standards and with the wings of each standard overlying and abutting the side web of the top header, all when the top header is installed. Holes provided through the thickness of the side web of the top header align with holes in the wings of the top ends of the standards and provide for the receipt therethrough of a fastener, such as a bolt or screw that also extends through an opening 50 in the wing of a standard to thereby anchor the top header and the standards to one another. In a preferred embodiment, the return web 226' of the bottom rail is about one-half inch shorter than the return web 226 of the top rail. By this means, a panel may be installed by first inserting the top end of the panel substantially fully into the channel of top rail, then pushed inwardly at its bottom end, and thereafter lowered into the channel of the bottom rail to cause both the top and bottom ends of the panel to reside within both the top and bottom rails, thereby assisting in the retention of the interlocking relationship of the lugs on the panel with the lugs on the standards.

Figure 9:
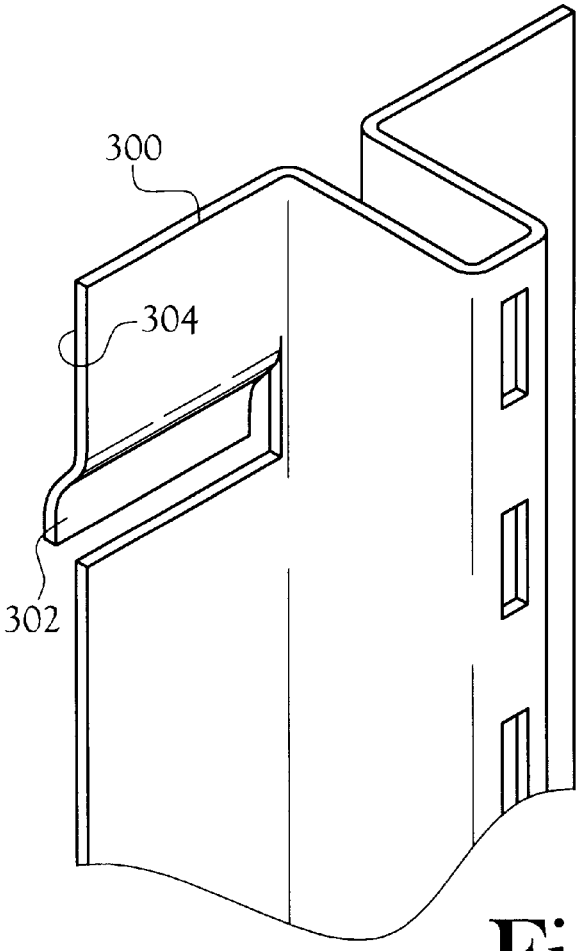
FIG. 9 is a representation of a portion of a further alternative standard useful in one embodiment of the present invention and depicting a rearwardly facing lug useful in attaching the standard to a supporting surface.
Figure 11:
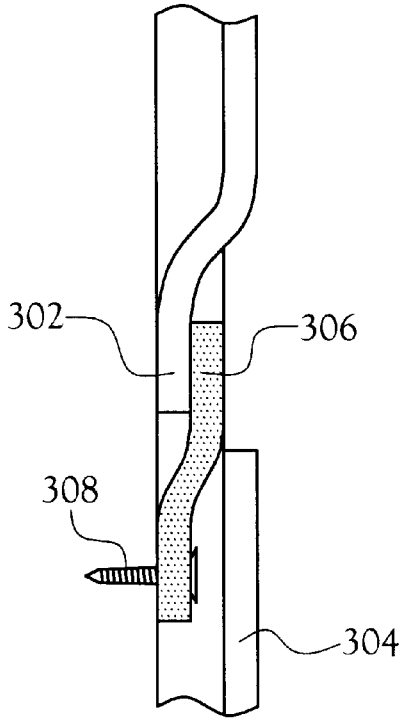
Figure 10:
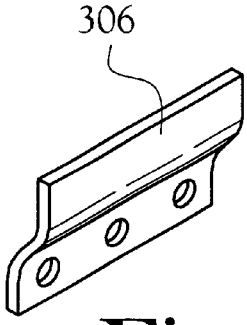
FIG. 10 is a representation of a bracket adapted to be anchored to a supporting surface and-thereafter to cooperatively receive one or more standards as depicted in FIG. 9; and, FIG. 11 is a side view of a standard as depicted in FIG. 9 interlocked with a bracket as depicted in FIG. 10.

An alternative embodiment for the mounting of a standard to a supporting upright surface is depicted in FIGS. 9–11 .

In the embodiment depicted in these Figures, one or more of the wings 300 of the standard is provided with a punched out lug 302 which projects downwardly and slightly rearwardly of the rear face 304 of the standard. This lug is receivable within a mounting bracket 306 as depicted in FIG. 10 and 11, that is itself attached to a supporting surface as by a fastener 308. If desired, the mounting bracket 306 may extend continuously in a horizontal attitude along the supporting surface to removably receive a plurality of standards along its length at spaced apart locations.

In one embodiment of a method for installing a panel wall system according to the present invention, the bottom rail is positioned either on a supporting floor, if the floor is truly horizontal, or otherwise is anchored to a supporting wall after having been adjusted to a true horizontal attitude. In the various components of the present panel wall system, the spacing between the holes in the wings of the standards, in the side webs of the bottom rail and the top header, etc., are spaced apart uniformly and at equal distances therebetween along the length of each such component of the wall system. One-inch on centers spacing is preferred. Once the bottom rail has been anchored in place, the bottom end of a standard is inserted into the channel defined by the bottom rail and attached to the bottom rail. This initially installed standard is thereupon aligned with the vertical and anchored to the supporting wall. These initially installed components therefore are aligned perpendicularly with respect to one another and thereupon serve as the vertical and horizontal reference locations for the installation of all further components of the wall system. By reason of the uniformly spacing of the holes provided in the standards and the top header, these components therefore are easily and precisely positioned and secured in their respective locations within the wall system.

Whereas the present invention has been described in specific terms and elements, it will be understood by one skilled in the art that equivalent elements, geometrical configurations, and other obvious modifications may be made without departing from the scope of the invention. For example, it will be recognized by one skilled in the art that any of several possible modes of fastening the standards to a wall may be employed. Further, whereas steel metal provides a rigid and strong supporting base for the panel wall system of the present invention, the standards may be formed from other non-combustible materials. Still further, as desired, one may provide lateral bracing between adjacent standards without departing from the scope of the present invention. Accordingly, it is intended that the present invention be limited only as set forth in the claims appended hereto.

Having thus described the aforementioned invention, I claim:

1. In a panel wall system for the mounting of one or more removable display panels in an upright attitude, the improvement comprising a plurality of elongated standards, each of said standards being of a "U"-shaped cross-section and formed from a non-combustible material and including a substantially flat planar face web and first and second opposite side margins, each of which side margins transitioning into respective first and second opposite side webs integrally formed with said face web and extending away from said face web, and a distal side edge, and including at least one wing extending laterally of and outwardly from said distal side edge, said wing being adapted to engage a support structure for said standard, at least one standard lug integrally formed with and projecting from each of said first and second side webs of each standard in a direction outwardly from a respective side web and away from said standard, means for mounting individual ones of said standards in a substantially upright attitude, at least one substantially flat planar panel member of a non-combustible material, said panel member including a front face and a planar web having first and second opposite side margins, at least one panel lug projecting from each of said side margins in a direction substantially perpendicular to said planar web, each of said panel lugs being of a geometry defining an outwardly opening slot, said slot being adapted to removably receive therein one of said standard lugs when said panel member is disposed alongside said standard associated with said one of said standard lugs, with said front face of said panel member being disposed substantially within the same plane and substantially flush with said face web of said standard.

2. The panel wall system of claim 1 wherein each of said wings is substantially coextensive with the distal edge of a respective side panel.

3. The panel wall system of claim 1 and including at least one row of openings extending through said face web of each of said standards, said openings being spaced equidistant from one another along the length of said face web.

4. The panel wall system of claim 3 and including a second row of openings extending through said face web of each of said standards, said openings being spaced equidistant from one another along the length of said face web and spaced laterally equidistant from said openings of said at least one row of openings.

5. The panel wall system of claim 1 wherein each of said standard lugs comprises a punch-out of a portion of a side web of said standard.

6. The panel wall system of claim 1 and including a plurality of panel lugs disposed in spaced apart relationship along the length of each of said side webs of each of said standards.

7. The panel wall system of claim 1 including at least two standards mounted in adjacent spaced-apart relationship to one another on a supporting surface in a substantially upright and substantially parallel attitude with one another, wherein each of said panel members includes a plurality of panel lugs disposed in spaced apart relationship along each of said opposite first and second side edges thereof, each of said plurality of panel lugs receiving and interlocking with a standard lug when said panel member is mounted between said adjacent spaced-apart standards.

8. The panel wall system of claim 7 wherein each of said side webs of each of said standards includes a distal edge and each of said standard lugs is disposed intermediate a respective side edge of said side web and said distal edge of said standard a distance which permits the engagement of each of said panel lugs with a respective one of said standard lugs to thereby removably mount said panel member between adjacent spaced-apart standards and with said planar front face of said panel member being flush with said planar face web of each of said standards.

9. The panel wall system of claim 8 wherein said panel member is of rectangular geometry when viewed in a frontal plan view and wherein said panel lugs of said panel member are disposed adjacent each of the opposite corners of said panel member thereby providing a four-point interconnection between said panel member and said adjacent standards.

10. The panel wall system of claim 7 wherein each of said panel lugs defines an outwardly opening slot for the receipt therein of a standard lug.

11. A panel wall system comprising a first standard of a non-combustible material including an elongated substantially planar face web having opposite first and second side edges, first and second elongated substantially planar side members having respective first and second opposite edges and being disposed along and integrally formed with respective ones of said side edges of said web and projecting substantially perpendicularly from said face web, each of said side members including an inner surface and an outer surface, first and second elongated substantially planar side wings, each having opposite first and second side edges, said first side edge of each of said side wings being disposed along and integrally formed with respective ones of said second side edges of said planar side members and projecting generally from said respective ones of said second side edges in a plane which is substantially parallel to, but spaced apart from, said face web, a plurality of standard lugs projecting substantially perpendicularly from said outer surface of each of said planar side members, said lugs being spaced apart from one another and spaced away from a respective side wing to thereby define an open space between each of said lugs and a respective side-wing, a panel member of a non-combustible material having a top end and a bottom end and including a substantially planar outer surface, said panel member having opposite first and second side edges each of which transitions into respective first and second side webs, each of which is oriented generally perpendicularly away from said planar outer surface of said panel member, at least one panel lug projecting from each of said side webs in a direction substantially perpendicular to said planar outer surface of said panel member, each of said panel lugs being of a geometry adapted to removably engage one of said standard lugs when said panel member is disposed alongside said standard associated with said one of said standard lugs and with said front face of said panel member being disposed substantially within the same plane and substantially flush with said planar face web of said standard.

12. The panel wall system of claim 11 wherein each of said standard lugs comprises a thin flat punch-out from a respective one of said side members of said standard.

13. The panel wall system of claim 12 wherein each of said panel lugs comprises a downwardly opening slot defined in said lug, said slot being dimensioned to receive therein one of said standard lugs whereby one side margin of said panel member is removably mountable to said standard.

14. The panel wall system of claim 11 wherein said system includes at least two standards mounted in adjacent spaced-apart relationship to one another on a supporting surface in a substantially vertical and substantially parallel attitude with one another, each standard having opposite first and second side margin portions, and wherein each of said panel members includes a plurality of panel lugs disposed in spaced apart relationship along each of said opposite first and second side margin portions thereof, each of said plurality of panel lugs receiving therein a standard lug when said panel member is mounted between said at least two adjacent spaced-apart standards.

15. A standard useful in a panel wall system which includes a plurality of planar panels having respective outer planar surfaces, respective first and second opposite side edges, and being mounted in an upright orientation between adjacent ones of a plurality of standards, comprising non-combustible material shaped to define an elongated substantially planar face web having opposite first and second side edges, first and second elongated substantially planar side members having respective first and second opposite edges and being disposed along and integrally formed with respective ones of said side edges of said web and projecting substantially perpendicularly from said face web, each of said side members including an inner surface and an outer surface, first and second elongated substantially planar side wings, each having opposite first and second side edges, said first side edge of each of said side wings being disposed along and integrally formed with respective ones of said second side edges of said planar side members and projecting generally from said respective ones of said second side edges in a plane which is substantially parallel to, but spaced apart from, said face web, a plurality of standard lugs integrally formed with and projecting substantially perpendicularly from said outer surface of each of said planar side members, said lugs being spaced apart from one another and spaced away from a respective side wing to thereby define an open space between each of said lugs and a respective side wing and also spaced apart from the plane of said planar face web whereby a panel disposed between at least two adjacent ones of said standards with its opposite side edges engaging one or more of said lugs on each of said standards may be positioned with its planar outer surface aligned substantially within the plane occupied by said face web of each of said at least two adjacent spaced-apart standards.

16. The standard of claim 15 wherein each of said lugs comprises a punch out of a respective side member.

17. The standard of claim 16 wherein each of said lugs comprises three sides thereof which project out of the plane of a respective side web member.

* * * * *